US006976418B2

(12) United States Patent
Hajek, Jr. et al.

(10) Patent No.: US 6,976,418 B2
(45) Date of Patent: Dec. 20, 2005

(54) HYDRAULIC SYSTEM WITH AN ACTUATOR HAVING INDEPENDENT METER-IN METER-OUT CONTROL

(75) Inventors: Thomas J. Hajek, Jr., Lockport, IL (US); Vincent Triffaux, Strepy-Bracquegnies (BE)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 10/751,589

(22) Filed: Jan. 5, 2004

(65) Prior Publication Data

US 2004/0139850 A1 Jul. 22, 2004

Related U.S. Application Data

(62) Division of application No. 09/406,893, filed on Sep. 28, 1999, now Pat. No. 6,691,604.

(51) Int. Cl.[7] ..... F15B 11/024
(52) U.S. Cl. ..... 91/436; 91/464
(58) Field of Search ..... 91/28, 436–439, 91/454, 464

(56) References Cited

U.S. PATENT DOCUMENTS 4,437,385 A * 3/1984 Kramer et al. ..... 91/361
5,220,862 A * 6/1993 Schexnayder ..... 91/436
5,233,909 A * 8/1993 Von Hoene ..... 91/436

* cited by examiner

*Primary Examiner*—F. Daniel Lopez
(74) *Attorney, Agent, or Firm*—Finnegan, Henderson, Farabow, Garrett & Dunner; D. James Barnes

(57) ABSTRACT

A fluid circuit is provided to independently control the flow of fluid into and out of each end of an actuator. This is accomplished by having two different independently controlled valves controlling the flow of fluid into and out of one end of the actuator and by having two other independently controlled valves controlling the flow of fluid into and out of the other end of the actuator. Regeneration of the fluid flow from one end of the actuator to the other end of the actuator is provided by blocking the exhaust flow of fluid to the reservoir by one of the independently controlled valves and redirecting the flow across the other of the independently controlled valves to join with the flow of the pump that is being directed to the other end of the actuator. This arrangement permits a portion or all of the fluid from one end of the actuator to be regenerated to the other end of the actuator.

3 Claims, 3 Drawing Sheets

CONTROLLER
"C"
A
L

10
CONTROLLER
"C"
L
A
12
14
16
18
20
22
24
26
28
30
31
32
34
36
38
42
44
52
54
56
58
60
64
66
68
70
72
74
76
78
80
82
88
90
92
94
96
98
100
102
104
106
108

HYDRAULIC SYSTEM WITH AN ACTUATOR HAVING INDEPENDENT METER-IN METER-OUT CONTROL

This is a Divisional of application Ser. No. 09/406,893, filed on Sep. 28, 1999 now U.S. Pat No. 6,691,604.

TECHNICAL FIELD

This invention relates generally to the control of an actuator in a hydraulic system and more particularly to a hydraulic system with an actuator having independent meter-in meter-out control which permits the actuator to regenerate flow from one end of the actuator to the other end and/or to permit interconnection of the ends of the actuator to provide a float function.

BACKGROUND ART

Hydraulic systems having independent control of fluid into and out of an actuator is generally known, such as that illustrated in FIGS. 6 and 12 of U.S. Pat. No. 4,662,601 which issued May 5, 1987. In these known systems, a separate poppet or check type of valve has been used to control the flow into and out of each end of the actuator. The above noted patent also provides a float mode of operation. Various types of poppet valves and various control schemes have been set forth to control the opening and closing of the valving element within the poppet valve. One such poppet valve and control scheme is set forth in U.S. Pat. No. 5,421,545 which issued Jun. 6, 1995 and is assigned to Caterpillar Inc. The poppet valve of '545 is effective to proportionally control the flow therethrough. However, when used in a fluid circuit that desires to provide selective flow regeneration from the one end of an actuator to the other end of the actuator or a float function, the control scheme becomes complicated. It is known to provide flow regeneration in fluid circuits using a poppet valve arrangement between a multiple position control valve and the actuator. However, when using a multi-position control valve, the ability to independently control the flow into and out of the respective ends of the actuator is limited. It is desirable to provide a fluid circuit that has the ability to independently control the fluid flow into and out of an actuator while also providing the ability to regenerate flow from the one end to the other end.

Accordingly, the present invention is directed to overcoming one or more of the problems as set forth above.

DISCLOSURE OF THE INVENTION

In one aspect of the present invention, a fluid circuit is provided and has a reservoir, a source of pressurized fluid connected to the reservoir, and an actuator having first and second inlet/outlet ports is selectively connected to the source of pressurized fluid and the reservoir. The fluid circuit is operative to selectively provide regenerative fluid flow from first inlet/outlet port of the actuator to the second inlet/outlet port thereof. The fluid circuit comprises a first poppet valve arrangement disposed between the source of pressurized fluid and the first inlet/outlet port of the actuator. The first poppet valve arrangement is operative to proportionally control the flow of fluid from the source of pressurized fluid to the first inlet/outlet port of the actuator. A second poppet valve arrangement is disposed between the first inlet/outlet port of the actuator and the reservoir and is operative to proportionally control the flow of fluid from the first inlet/outlet port of the actuator to the reservoir. A third poppet valve arrangement is disposed between the source of pressurized fluid and the second inlet/outlet port of the actuator and operative to proportionally control the flow of fluid from the second inlet/outlet port of the actuator to the reservoir. A control valve arrangement is connected to the source of pressurized fluid in parallel with the first poppet valve arrangement and is disposed between the source of pressurized fluid and the second inlet/outlet port of the actuator. The control valve arrangement is operative to proportionally control the flow of fluid from the source of pressurized fluid to the second inlet/outlet port of the actuator and to control the regenerative flow of fluid from the second inlet/outlet port of the actuator to the first inlet/outlet port of the actuator. A controller is provided and is operative in response to an input command to control the fluid flow into and out of the respective ends of the actuator.

BEST MODE FOR CARRYING OUT THE INVENTION

Figure 1:
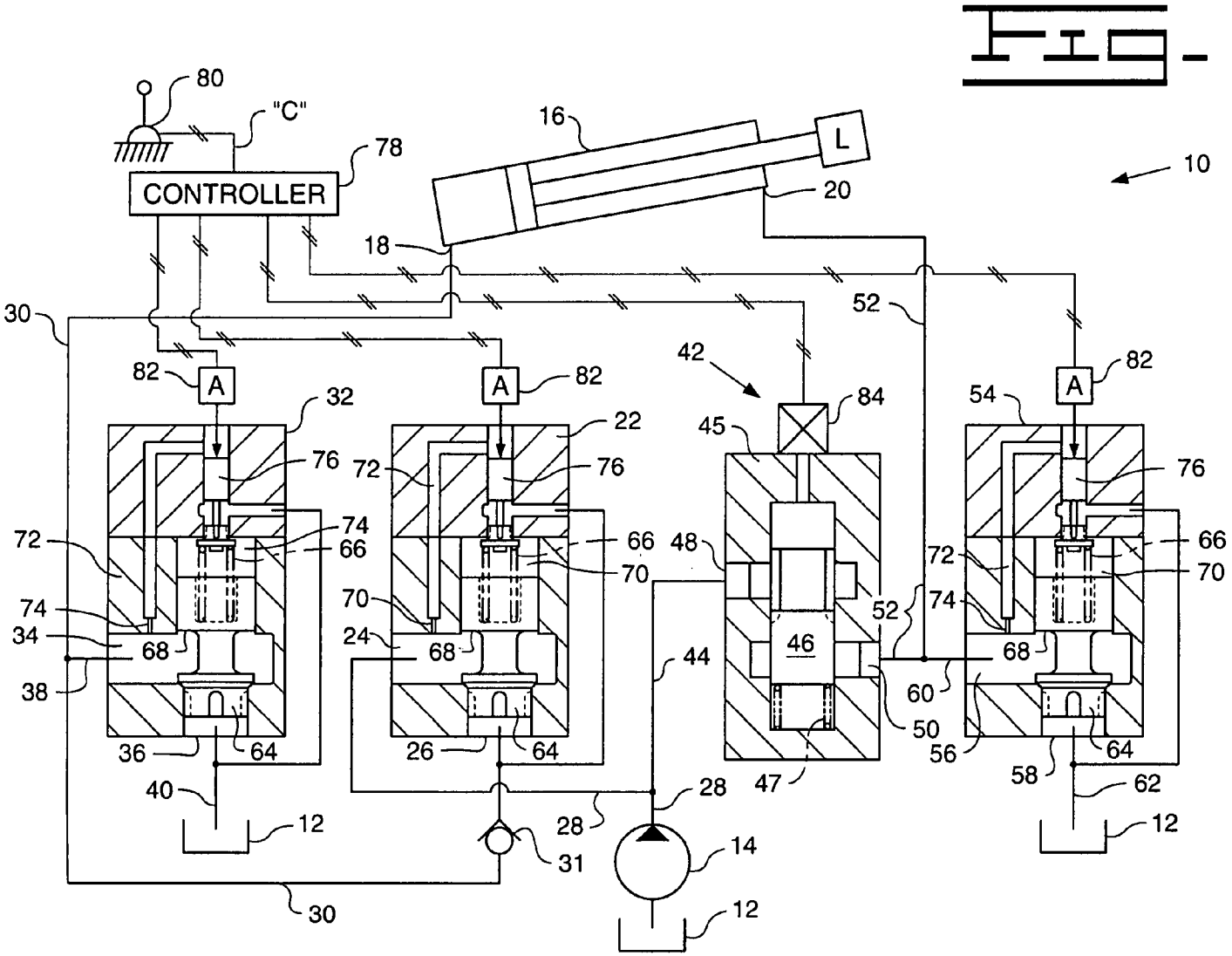
FIG. 1 is a partial schematic and a partial diagrammatic representation of a fluid circuit incorporating an embodiment of the present invention.

Referring to the drawings and more specifically to FIG. 1, a fluid circuit 10 is illustrated and includes a reservoir 12, a source of pressurized fluid, such as a pump 14 that receives fluid from the reservoir, and an actuator 16 that is selectively connected to the source of pressurized fluid. The actuator 16 has first and second inlet/outlet ports 18,20 and in the subject arrangement the first and second inlet/outlet ports 18,20 are respective head end and rod end ports.

A first poppet valve arrangement 22 has first and second flow ports 24,26 and the first flow port 24 thereof is connected to the pump 14 by a first supply conduit 28. The second flow port 26 is connected to the first inlet/outlet port 18 of the actuator 16 by a conduit 30. A load check valve 31 is disposed in the conduit 30 generally adjacent to the second flow port 26 of the first poppet valve arrangement 22 and operative to permit flow in the conduit 30 away from the first poppet valve arrangement 22 and to prohibit flow therein towards the second flow port 26.

A second poppet valve arrangement 32 has first and second flow ports 34,36 and the first flow port 34 thereof is connected to the first inlet/outlet port 18 of the actuator 16 by a conduit 38 and a portion of the conduit 30. The second flow port 36 thereof is connected to the reservoir 12 by an exhaust conduit 40.

A control valve arrangement 42 is connected in parallel to the pump 14 by a second supply conduit 44 and a portion of the first supply conduit 28. In the subject embodiment, the control valve arrangement 42 is a spool type valve 45 having a spool 46 slideably disposed therein that is biased to a flow blocking position by a spring 47. The spool type valve 45 has first and second flow ports 48,50. The second supply 44 conduit is connected to the first flow port 48 and the second flow port 50 thereof is connected to the second inlet/outlet port 20 of the actuator 16 by a conduit 52.

A third poppet valve arrangement 54 is provided and has first and second flow ports 56,58. The first flow port 56 thereof is connected to the second inlet/outlet port 20 of the actuator 16 by a conduit 60 and a portion of the conduit 52. The second flow port 58 thereof is connected to the reservoir 12 by an exhaust conduit 62.

Each of the first, second, and third poppet valve arrangements 22,32,54 has a poppet valving element 64 that is biased to a flow blocking position by a spring 66 and urged towards a flow passing position by pressurized fluid acting on the end of the poppet valving element 64 or by pressurized fluid acting on an effective area of a shoulder 68. A fluid control chamber 70 is defined therein at the spring biased end of the poppet valving element 64. The fluid control chamber 70 is in communication with the respective first flow ports 24,34,56 by a passage 72 having an orifice 74 defined therein. A force balanced control spool 76 is disposed in each of the poppet valve arrangements 22,32,54 and operative to selectively and controllably vent fluid flow from the respective fluid control chambers 70 to an area of lower pressure. The force balanced control spool 76 functions to provide a variably controlled orifice between the fluid control chamber 70 and the area of lower pressure. The area of lower pressure may be the reservoir or some other conduit that is at a low pressure level relative to the pressure in the fluid control chamber 70.

A controller 78 is provided and operative to receive an input command "C" from an operator input mechanism 80, process the input command "C" and deliver appropriate signals to the respective control actuators 82 of the first, second, and third poppet valve arrangements 22,32,54. Each of the control actuators 82 of the subject embodiment are electrically controlled actuators that exert a force to move the respective forced balanced control spools 76 towards a fluid passing position in proportion to the magnitude of the signals from the controller 78. The controller 78 also delivers a control signal to a position controller 84 of the spool type valve 45 to move the spool 46 in proportion to the magnitude of the signal from the controller 78. It is recognized that various control actuators 82 or position controllers 84 could be used without departing from the essence of the subject invention.

Figure 2:
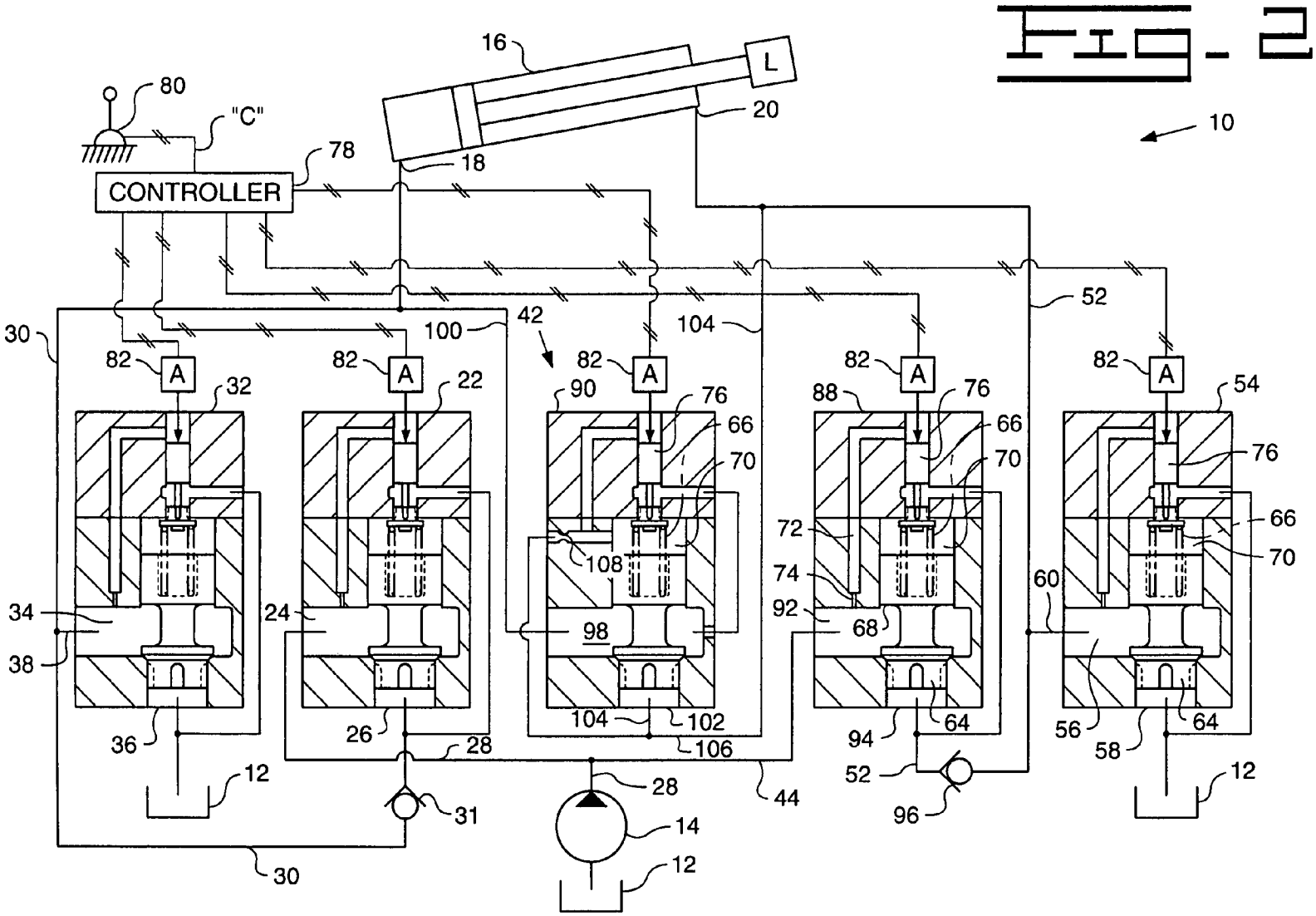
FIG. 2 is a partial schematic and a partial diagrammatic representation of a fluid circuit incorporating another embodiment of the present invention.

Referring to FIG. 2, another embodiment of the subject fluid system 10 is illustrated. Like elements have like element numbers. In the embodiment of FIG. 2, the control valve arrangement 42 includes first and second proportionally controlled poppet valves 88,90. The first and second proportionally controlled poppet valves 88,90 are substantially the same as the first, second and third poppet valve arrangements 22,32,54. The first proportionally controlled poppet valve 88 has a first flow port 92 connected to the second supply port 44 and a second flow port 94 connected to the conduit 52 leading to the second inlet/outlet port 20 of the actuator 16. A load check valve 96 is disposed in the conduit 52 generally adjacent to the second flow port 94 of the first proportionally controlled poppet valve 88 and operative to only permit flow away from the second flow port 98. Like the first, second and third poppet valve arrangements 22,32,54, the first proportionally controlled poppet valve 88 is controlled by the control actuator 82 which receives a signal from the controller 78.

The second proportionally controlled poppet valve 90 is disposed between the first and second inlet/outlet ports 18,20. The second proportionally controlled poppet valve 90 is very similar to the first proportionally controlled poppet valve 88. It has a first flow port 98 connected to the first inlet/outlet port 18 of the actuator 16 by a conduit 100 and a second flow port 102 connected to the second inlet/outlet port 20 by a conduit 104. The fluid control chamber 70 of the second proportionally controlled poppet valve 90 is connected to the second flow port 102 thereof by a conduit 106 having an orifice 108 defined therein. The second proportionally controlled poppet valve 90 is likewise controlled by another control actuator 82.

Figure 3:
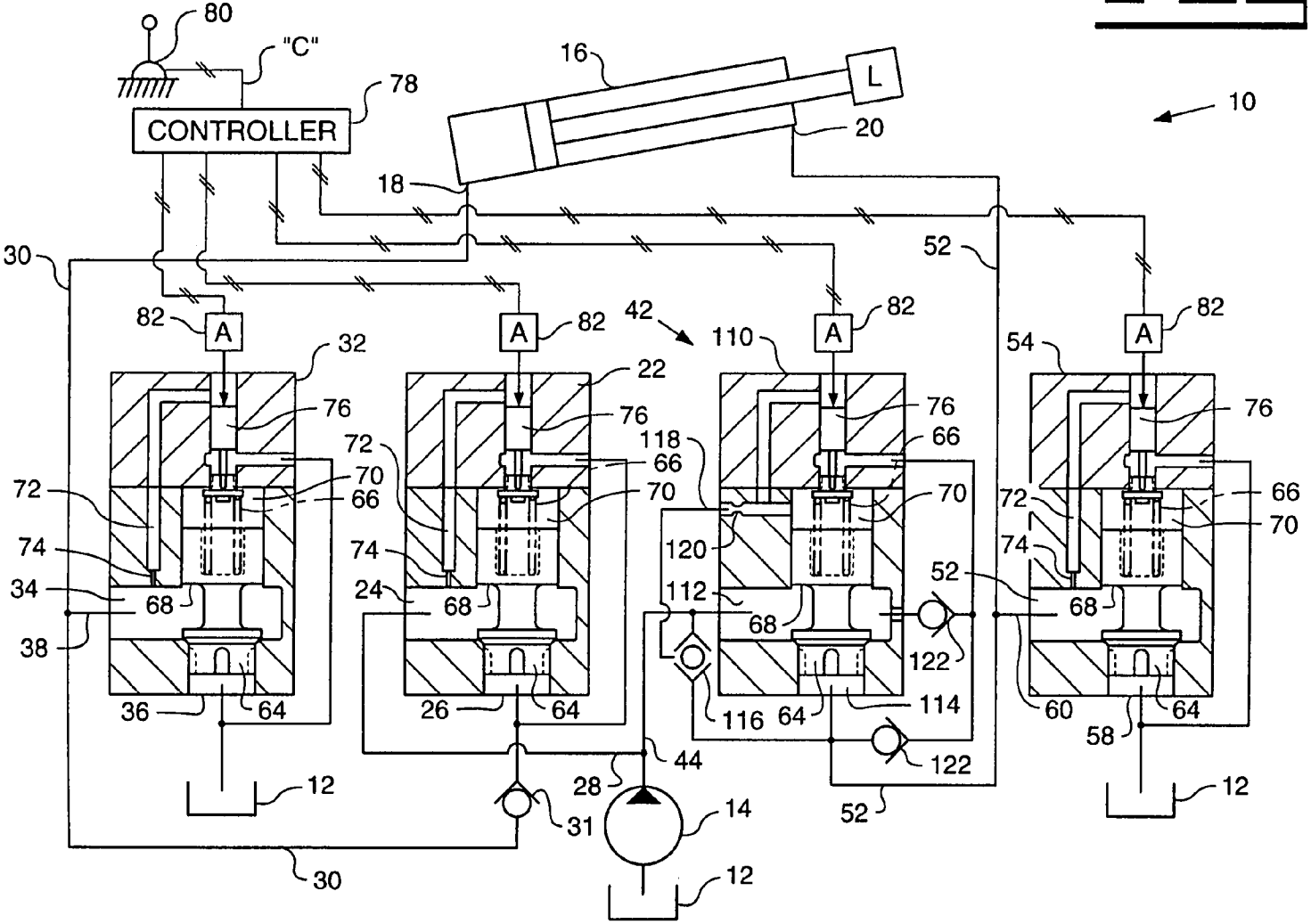
FIG. 3 is a partial schematic and a partial diagrammatic representation of a fluid circuit incorporating yet another embodiment of the present invention.

Referring to FIG. 3, another embodiment of the subject invention is illustrated. This embodiment is very similar to the other embodiments. Consequently, like elements have like element numbers. The control valve arrangement 42 of the subject embodiment includes a fourth poppet valve arrangement 110. Like the first, second, and third poppet valve arrangements 22,32,54, it has a valving element 64 that is biased to a flow blocking position by a spring 66 and has the fluid control chamber 70 defined adjacent the spring biased end. It has a first flow port 112 connected to the second supply conduit 44 and a second flow port 114 connected to the conduit 52 leading to the second inlet/outlet port 20 of the actuator 16. In the subject arrangement, a resolver valve 116 is connected to the respective conduits 44,52 and the higher pressure therebetween is communicated to the fluid control chamber 70 of the fourth poppet valve arrangement 110 through a conduit 118 having an orifice 120 defined therein. The fluid being exhausted or vented through the force balanced control spool 76 is directed to the low pressure area by a check valve arrangement 122. The fourth poppet valve arrangement 110 is likewise controlled in response to receipt of a signal from the controller 78 to its control actuator 82.

It is recognized that the elements of the subject invention could be connected in various ways without departing from the essence of the claimed invention. For example, each of the respective first and second flow ports of the first, second, third and fourth poppet valve arrangements 22,32,54,110 and the first and second proportionally controlled poppet valves 88,90 could be connected opposite to the way they are connected in the subject embodiments. More specifically, for example, the first fluid port 24 could be connected to the conduit 30 and the second fluid port 26 could be connected to the supply conduit 28. When the first and second fluid ports 24,26 are connected in such a manner, it would also be necessary to have the passage 72 with the orifice 74 therein connected to the second fluid port 26 and the fluid being vented from the fluid control chamber 70 connected to the first fluid port 24. The respective valves still function in the same manner to control the flow of fluid thereacross. It is also understood that the fluid connections to the first and second fluid ports 48,50 of the spool type valve 45 could likewise be changed without departing from the essence of the subject invention.

INDUSTRIAL APPLICABILITY

In the operation of the embodiment of FIG. 1, an input through the operator input mechanism 80 directs the input command "C" to the controller 78. The controller 78 processes the input command and generates appropriate control signals therefrom. For example, if the operator's input is for the actuator 16 to extend, a signal is directed to the control actuator 82 of the first poppet valve arrangement 22. Since the fluid control chamber 70 is pressurized by fluid being directed thereto through the orifice 74 and conduit 72, the poppet valving element 64 is held in its flow blocking position. Movement of the force balanced control spool 76 controllably vents fluid from the fluid control chamber 70. As fluid is vented from the control chamber 70, the pressure therein reduces. The fluid at the first flow port 24 acts on the effective area 68 of the valving element 64 moving it against the bias of the spring 66 and the lower pressure of the fluid in the control chamber 70. As the valving element 64 moves to a flow passing position, pressurized fluid is directed through the conduit 30 to the first inlet/outlet 18 of the actuator 16.

Simultaneous with the signal from the controller 78 being directed to the first poppet valve arrangement 22, another signal is directed to the actuator 82 of the third poppet valve arrangement 54. This is necessary in order to permit the fluid being exhausted from the second inlet/outlet port 20 to be passed to the reservoir 12. Following movement of the force balanced control spool 76 of the third poppet valve arrangement, the pressure of the fluid at the first flow port 56 thereof urges the valving element 64 towards a flow passing position thus allowing the fluid from the second inlet/outlet port 20 to controllably pass to the reservoir 12. This arrangement permits precise control of the fluid into and out of the actuator 16. The load check valve 31 functions to maintain the actuator in a given position if the pump 14 happens to be operating at a lower pressure level when the first poppet valve arrangement 22 opens.

When it is desirable to retract the actuator 16 in response to an input command by the operator, a signal is directed to the position controller 84 of the spool type valve 45. The spool 46 thereof is proportionally moved towards a flow passing position against the bias of the spring 47 thus passing pressurized fluid to the second inlet/outlet 20. The fluid being exhausted from the first inlet/outlet 18 is controllably directed to the reservoir 12 across the second poppet valve arrangement 32 in response to a signal being directed to the control actuator 82 thereof from the controller 78.

In various operations, it is desirable to utilize the fluid being exhausted from one end of the actuator 16 to fill the other end thereof. In the subject embodiment, it is desirable to regenerate all or part of the fluid from the second inlet/outlet port 20 to aid the pump 14 in filling of the first inlet/outlet port 18. This may be done in any circuit where the actuator 16 is extending at a rate faster than the flow from pump 14 can fill the first inlet/outlet port 18 or where the force needed to continue extending the actuator 16 is within a predetermined value. In order to regenerate all of the fluid from the second inlet/outlet port 20 when extending the actuator 16, the third poppet valve arrangement 54 remains closed. However, the spool type valve 45 is moved towards an open position thus allowing the exhaust flow in the conduit 52 to flow across the spool 46 and combine with the pump flow in supply conduits 44,28. The combined flow is directed across the first poppet valve arrangement 22 through the conduit 30 to the first inlet/outlet port 18. Even if there is pressurized fluid in the second inlet/outlet port 20, the actuator 16 continues to extend. This remains true as long as the force of the pressurized fluid acting in the first inlet/outlet port 18 is sufficient to move the load. In the subject embodiment, even though there is pressurized fluid in the second inlet/outlet port 20, there is always a force equal to the product of the pressure in the first inlet/outlet port 18 acting on an area equal to the diameter of the actuator rod. If the actuator 16 is extending at a fast rate, the pressure of the fluid in the second inlet/outlet port 20 will normally be no higher than that attributed to the resistance of the flow of fluid therefrom.

If it is desirable to only regenerate a portion of the fluid from the second inlet/outlet port 20 to the first inlet/outlet port 18, the spool 46 is moved to a flow controlling position and the third poppet valve arrangement 54 is also moved to a flow controlling position. By increasing or decreasing the flow through each of the spool type valve 45 and the third poppet valve arrangement 54, the magnitude of the flow regeneration can be closely controlled. By using a spool type valve 45, regeneration can be achieved in a simple and less complicated manner. However, it is recognized that this arrangement might not be satisfactory in some circuits.

Referring to the operation of the embodiment of FIG. 2, the normal extension and retraction of the actuator 16 is basically the same. The main difference being that the spool type valve 45 has been replaced with first and second proportionally controlled poppet valves 88,90. A second load check valve 96 has also been placed in the conduit 52 leading to the second inlet/outlet port 20. Use of the first proportionally controlled poppet valve 88 and the second load check valve 96 provides a more precise control of the extension and retraction of the actuator 16. In this arrangement, in order to achieve regeneration of fluid flow from the second inlet/outlet port 20 to the first inlet/outlet port 18, the second proportionally controlled poppet valve 90 is located between the first and second inlet/outlet ports 18,20 of the actuator 16.

In this arrangement, when it is desired to regenerate all of the fluid flow from the second inlet/outlet port 20 to the first inlet/outlet port 18, the third poppet valve arrangement 54 is closed and the second proportionally controlled poppet valve 90 is controllably opened. The flow from the second inlet/outlet port 20 is directed to the first flow port 98 thereof and out the second flow port 102 to the first inlet/outlet port 18. The first poppet valve arrangement 22 remains open to the extent needed to keep the first inlet/outlet port 18 full of fluid. If it is desirable to further pressurize the fluid at the first inlet/outlet port, the first poppet valve arrangement 22 may be opened more in response to a change in the signal received from the controller 78. The pressurized fluid in the fluid control chamber 70 is directed thereto from the second inlet/outlet port 20 through the conduit 106 and the orifice 108.

If it is desirable to regenerate only a portion of the fluid from the second inlet/outlet port 20, the second proportionally controlled poppet valve 90 is moved to a flow controlling position and the third poppet valve arrangement 54 is likewise moved to a flow controlling position. By controlling the respective positions of the second proportionally controlled poppet valve 90 and the third poppet valve arrangement 54, the magnitude of flow regeneration from the second inlet/outlet port 20 to the first inlet/outlet port 18 can be controlled.

Referring to the operation of FIG. 3, the control valve arrangement includes a fourth poppet valve arrangement 110. This fourth poppet valve arrangement 110 is substantially identical to that of the first, second, and third poppet valve arrangements 22,32,54. In the subject embodiment, the fourth poppet valve arrangement 110 operates to controllably direct pressurized fluid to the second inlet/outlet port 20 from the pump 14 to retract the actuator 16 but also serves to provide regeneration of fluid from the second inlet/outlet port 20 to the first inlet/outlet port 18. The fourth poppet valve arrangement 110 functions like the first poppet valve arrangement 22 when desiring to direct pressurized from the pump 14 to the second inlet/outlet port 20. The resolver 116 detects the pressurized fluid in the first supply conduit 44 and directs it through the conduit 118 and orifice 120 to the fluid control chamber 70. The fluid being vented from the fluid control chamber 70 is directed through the check valve arrangement 122 to the low pressure area, in this case the conduit 52 is at a lower pressure than that in supply conduit 44.

When regenerating all of the fluid from the second inlet/outlet port 20, the third poppet valve arrangement 54 is moved to a flow blocking position and the fourth poppet valve arrangement 110 is moved towards a flow passing position. In this instance, the pressure of the fluid in the conduit 52 attempting to be exhausted from the second inlet/outlet port 20 is directed through the resolver valve 116, the conduit 118 and the orifice 120 to the fluid control chamber 70. Until fluid is vented from the fluid control chamber 70, the fluid in the conduit 52 cannot open the valving element 64. Once the force balanced control spool 76 is moved to a flow passing-position, the valving element 64 opens and allows fluid flow from the conduit 52 to combine with the pump flow in the first and second supply conduits 44,28. The combined flow is directed across the first poppet valve arrangement 22 to the first inlet/outlet port 18.

If it is desired to regenerate only a portion of the fluid being exhausted from the second inlet/outlet port 20, both the third poppet valve arrangement 54 and the fourth poppet valve arrangement 110 are controllably moved towards their respective flow passing positions. By controlling their respective positions, any desired portion of fluid flow from the second inlet/outlet port 20 can be regenerated back to the first inlet/outlet port 18.

In each of the embodiments, if it is desirable to provide a float function for the actuator 16, the operator makes an input to the input mechanism 80 to generate the appropriate input command "C" to the controller 78. Appropriate signals are delivered from the controller 78 to the second and third poppet valve arrangements 32,54 to vent the respective fluid chambers 70 thus simultaneously connecting both of the inlet/outlet ports 18,20 to the reservoir 12. Consequently, the actuator 16 is free to extend or retract, i.e. float.

Other aspects, objects and advantages of the present invention can be obtained from a study of the drawings, the disclosure and the appended claims.

What is claimed is:

1. A fluid circuit operative to selectively provide regenerative fluid flow between respective ends of a fluid actuator, the fluid circuit has a reservoir, a source of pressurized fluid connected to the reservoir, and said actuator having first and second inlet/outlet ports selectively connected to the source of pressurized fluid and the reservoir, the fluid circuit comprising:

a first poppet valve arrangement disposed between the source of pressurized fluid and the first inlet/outlet port of the actuator and operative to proportionally control the flow of fluid from the source of pressurized fluid to the first inlet/outlet port of the actuator;

a second poppet valve arrangement disposed between the first inlet/outlet port of the actuator and the reservoir and operative to proportionally control the flow of fluid from the first inlet/outlet port of the actuator to the reservoir;

a third poppet valve arrangement disposed between the reservoir and the second inlet/outlet port of the actuator and operative to proportionally control the flow of fluid from the second inlet/outlet port of the actuator to the reservoir;

a control valve arrangement connected to the source of pressurized fluid and disposed between the source of pressurized fluid and the second inlet/outlet port of the actuator and operative to proportionally control the flow of fluid from the source of pressurized fluid to the second inlet/outlet port of the actuator, the control valve arrangement being configured to control the regenerative flow of fluid from the second inlet/outlet port of the actuator to the first inlet/outlet port of the actuator;

a controller that is operative in response to an input command to control the fluid flow into and out of the respective ends of the actuator, wherein the control valve arrangement includes a first proportionally controlled poppet valve disposed between the source of pressurized fluid and the second inlet/outlet port of the actuator and a second proportionally controlled poppet valve disposed between the first inlet/outlet port and the second inlet/outlet port of the actuator free of a check valve.

2. The fluid circuit of claim 1 wherein each of the first and second proportionally controlled poppet valves is controllably opened in response to receipt of a control signal from the controller.

3. The fluid circuit of claim 2 wherein directing respective control signals to the first poppet valve arrangement and to the second proportionally controlled poppet valve controllably regenerates fluid from the second inlet/outlet port of the actuator to the first inlet/outlet port thereof.

* * * * *